United States Patent [19]

Sugiyama et al.

[11] 4,372,779

[45] Feb. 8, 1983

[54] IRON ORE PELLETS CONTAINING COARSE ORE PARTICLES

[75] Inventors: Takeshi Sugiyama; Shoji Shirouchi; Osamu Tsuchiya, all of Kobe; Mamoru Onoda, Miki; Atsuko Yamashita, Kobe; Isao Fujita, Kobe; Nobuyuki Imanishi, Kobe, all of Japan

[73] Assignee: Kobe Steel, Ltd., Kobe, Japan

[21] Appl. No.: 194,842

[22] Filed: Oct. 7, 1980

[30] Foreign Application Priority Data

Oct. 9, 1979 [JP] Japan ..... 54-130536

[51] Int. Cl.[3] ..... C22B 1/14

[52] U.S. Cl. ..... 75/0.5 R; 75/3

[58] Field of Search ..... 75/0.5 R, 3-5

[56] References Cited

U.S. PATENT DOCUMENTS 3,969,103 7/1976 Capers et al. ..... 75/3

4,197,115 4/1980 Suzuki et al. ..... 75/3

FOREIGN PATENT DOCUMENTS 54-117301 9/1979 Japan ..... 75/3

1364150 8/1974 United Kingdom ..... 75/3

OTHER PUBLICATIONS

Davison, J., et al., "Pelletizing Relatively Coarse Iron Ores", *J. of Iron and Steel Inst.,* pp. 443-451.

Merklin, et al., "The Coarse Specularite—Fine Magnetite Pelletizing Process," *Agglomeration* Interscience Pub.; pp. 965-975, (1961).

*Primary Examiner*—Michael L. Lewis

*Attorney, Agent, or Firm*—Oblon, Fisher, Spivak, McClelland & Maier

[57] ABSTRACT

Iron ore pellets containing coarse ore particles, having a particle size distribution consisting of 25-40 wt % of coarse ore having a particle size greater than 0.1 mm, less than 21 wt % of medium ore having a particle size of 0.1-0.04 mm, and more than 39 wt % of fine ore having a particle size smaller than 0.04 mm.

3 Claims, 3 Drawing Figures

IRON ORE PELLETS CONTAINING COARSE ORE PARTICLES

BACKGROUND OF THE INVENTION

This invention relates to iron ore pellets containing coarse ore particles, and more particularly to iron ore pellets which can be produced with a high pelletizing efficiency and which show excellent reducibility at high temperatures and physical strengths.

Iron ore pellets were originally developed as a technique for refining low grade ores, producing iron ore moldings suitable as a feed material of a blast furnace after grinding and sorting low grade iron ores into a powdery form with an increased iron content. However, the ore pellets have come to have a greater significance even to ores of higher grades for effectively utilizing the fine ore powder which occurs in mining and subsequent sintering stages.

In most cases, the conventional iron ore pellets are produced by pelletizing and sintering raw ore material of finely ground powdery form more than 70 to 90 wt % of which have a particle size smaller than 325 mesh (about 0.04 mm). This is because a high percentage of coarse particles in the pelletizing material narrows the range of moisture content which is suitable for pelletization, lowering the efficiency of pelletization and resulting in green pellets with considerably poor physical strengths (especially dropping strength). Ore pellets which are formed from a material containing fine ore particles in a large proportion are superior in strengths after sintering and low temperature reduction but have a great difficulty in practical applications in that they are inferior in reducibility at high temperature which is the most important property to a feed material to a blast furnace.

With the foregoing in view, the present inventors have conducted extensive studies for the purpose of improving the reducibility of iron ore pellets at high temperatures, and as a result found that iron ore pellets obtained by pelletizing and sintering fine ore powder containing 25 to 40 wt % of coarse particles of 0.1 mm or greater in diameter have improved reducibility at high temperatures. The pellets which are formed from fine ore powder containing a suitable amount of coarse ore particles have bridge-like slag bonds formed by self-fluxing fine particles between the individual coarse particles and contain an increased number of open pores. Therefore, the pellets are free of metal iron shells which are the main cause of low reducibility, and the metal iron is formed even in the inner regions of the individual pellets. As a result, the quantity of wustite which produces low melting point slag is reduced, the open pores become less susceptible to clogging and the softening contraction at high temperatures is lowered. In addition, upon softening under loaded high temperature conditions, the coarse ore particles play a role of an aggregate which lessens the deformations at high temperatures, ensuring excellent reducibility at high temperatures. In a case where the coarse ore content is limited to about 40%, the lowering in pelletizability and strengths of the pellets is prevented to some extent although the values are apparently lower than those of the pellets which are produced from fine ore powder alone.

SUMMARY OF THE INVENTION

Under these circumstances, the present inventors continued the research with an object of further improving pelletizability and pellet strengths while maintaining good reducibility of ore pellets at high temperatures, and found that the object is achieved by limiting the content of coarse particles to a particular range along with the content of medium and fine ore particles to have a proper particle size distribution for green pellets as described hereinafter.

More particularly, the iron ore pellets according to the present invention have, in the form of green pellets prior to the firing stage, a particle size distribution consisting of 25–40 wt % of coarse ore having a particle size greater than 0.1 mm, less than 21 wt % of medium ore having a particle size of 0.1–0.04 mm, and more than 39 wt % of fine ore having a particle size smaller than 0.04 mm.

The above and other objects, features and advantages of the invention will become apparent from the following particular description of the invention and the appended claims, taken in conjunction with the accompanying drawings.

PARTICULAR DESCRIPTION OF THE INVENTION

Figure 1:
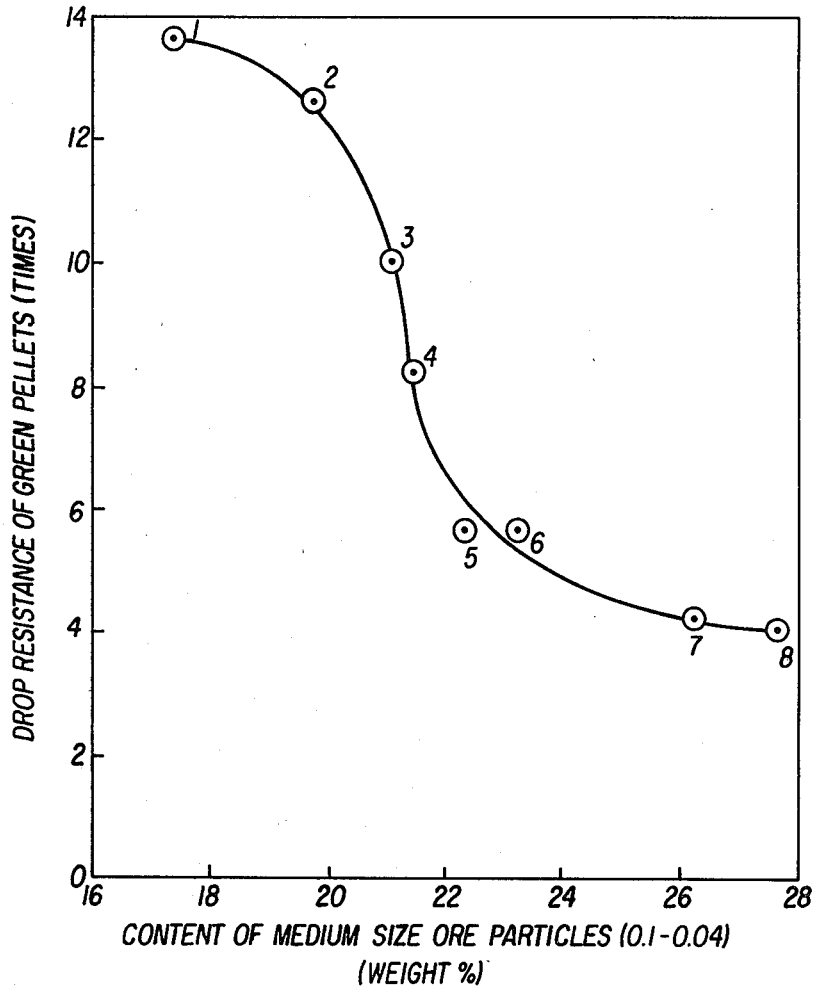
FIG. 1 is a graph showing the relation between the content of medium ore particles (0.1–0.04 mm) in green pellets and the drop resistance.

The invention is hereafter described more particularly by way of what are presently considered preferred embodiments of the invention. However, it is to be understood that the invention is not limited to the particular embodiments shown and includes all the modifications and changes which are possible within the scope of the invention as defined by the appended claims.

According to the present invention, the above-defined particle size distribution of the ore powder for green pellets was determined for the following reasons.

Firstly, the content of coarse ore having a particle size greater than 0.1 mm is limited to the range of 25 to 40 wt %. This is because a coarse ore content of at least 25 wt % is necessary for securing in a sufficient degree the effects of increasing the open porosity to prevent degradation in reducibility and suppressing softening contraction at high temperatures, along with the effect as an aggregate which prevents deformations of pellets at high temperatures to ensure high reducibility at high temperatures. However, an excessive content of coarse particles lowers the pelletizability and pellet strengths even if the contents of medium and fine ore particles are in the predetermined ranges, so that coarse ore content should be lower than 40 wt %. In this connection, it is to be noted that gigantic ore particles greater than 1 mm in diameter considerably lowers the pelletizability and pellet strengths so that the coarse ore is preferred to have a particle size between 0.1 mm and 1 mm and the proportion of the gigantic particles over 1 mm should be adjusted to a value smaller than 20% by weight.

In the production of ore pellets, the prior art paid no particular attention to the proportion of the medium and fine ore particles smaller than 0.1 mm in the particle size distribution for green pellets. However, it has been confirmed by experiments that the proportion of the medium ore particles of 0.1 to 0.04 mm has a great influence on the strengths of green pellets. More particularly, in the just-mentioned experiments, different kinds of iron ore pellets were produced by varying the proportion of the medium ore particles of 0.1 to 0.04 mm in the powder containing about 30 wt % of coarse ore particles of 1 to 0.1 mm, and the drop resistance of each kind of pellet was measured (by dropping the pellets repeatedly from a height of 30 cm until they broke into two or more pieces and indicating the strength by the average number of drops in five dropping tests). The results are shown in Table 1 and FIG. 1. The numerals in FIG. 1 correspond to the pellet numbers in Table 1.

TABLE 1

| Pellet No. | Particle Size Distribution (Wt %) 1–0.1 mm | 0.1–0.04 mm | 0.04–0.01 mm | 0.01 mm< | Drop Resistance (number of drops |
|---|---|---|---|---|---|
| 1 | 34.2 | 16.3 | 24.2 | 24.3 | 13.6 |
| 2 | 30.7 | 19.6 | 26.1 | 23.6 | 12.6 |
| 3 | 31.9 | 21.0 | 25.7 | 21.4 | 10.0 |
| 4 | 31.4 | 21.4 | 26.4 | 20.8 | 8.2 |
| 5 | 31.5 | 22.3 | 28.3 | 17.9 | 5.6 |
| 6 | 29.3 | 23.2 | 29.1 | 18.4 | 5.6 |
| 7 | 28.9 | 26.2 | 30.3 | 14.6 | 4.2 |
| 8 | 27.6 | 27.1 | 31.7 | 13.6 | 4.0 |
| 9 | 38.6 | 19.0 | 27.8 | 14.2 | 15.0 |

As clear from Table 1 and FIG. 1, there is a significant correlation between the content of medium ore particles of 0.1 to 0.04 mm and the drop resistance of the resulting green pellets, the latter lowering abruptly when the content of medium ore particles is increased above the turning point at about 21 wt %. Thus, the content of medium ore particles is determined to be below 21 wt % and preferably below 20 wt % to secure a higher drop resistance. It is also observed that the pellet No. 9 which has a high coarse ore content (38.6 wt %), close to the upper limit, shows a high drop resistance although the content of fine ore particles (smaller than 0.01 mm) is as low as 14.2 wt %. This is considered to be attributable to the low content of medium ore particles (19.0 wt %) and also indicates the influence of the medium ore content on the pellet strength.

The content of fine ore particles smaller than 0.04 mm is essential for enhancing the yield of pelletization and is required to be at least greater than 39 wt % in order to ensure a pelletizability which is acceptable in applications of industrial scale. However, with a pelletizing ore powder containing coarse and medium size particles as in the present invention, a fine particle content less than 39 wt % extremely degrades the pelletizability, resulting in irregular pellet sizes especially due to the limited range of moisture content which makes it difficult to attain the optimum moisture content for the pelletization and thus in a lowered yield of pellets of intended sizes.

In addition to the particle size distribution of the pelletizing ore powder, our research covered the influences of the gangue mineral contents ($SiO_2$, $Al_2O_3$, CaO, etc.) in the ore powder. As a result, it has also been confirmed that the gangue mineral components (1) melts FeO at high temperatures, forming molten slag which hinders the progress of reduction by clogging open pores of the pellets or by covering the surfaces of ore particles, (2) invites production of a large quantity of molten slag which tends to exude from the surfaces of the individual pellets and causes them to stick to each other, and (3) as a result induces stagnation of reduction in the high temperature zone of the blast furnace, the sticking pellets inducing abnormal movements to the lowering charged material in the furnace and unstabilizing the furnace conditions by the hang-down and blow-by phenomena which disturbs the distribution of gas flows and the heat balance. Thus, our research was furthered on the assumption that the improving effect accruing from the restriction of the particle size distribution might be augmented by restricting the gangue content.

As a result, it has been confirmed that the production of low melting point slag is suppressed and the pellet strength after sintering and low temperature reduction can be improved all the more by adjusting the pellet composition such that the basicity of the sum of the fine and medium ore components (hereinafter referred to "fine/medium ore") become higher than 1.0. It has also been proved that the basicity of coarse ore which has a large surface area has little influence on the above-mentioned effects.

It has also been confirmed that the gangue contents ($CaO+SiO_2+Al_2O_3$) in the fine/medium and coarse ore particles have a great influence on the reducibility at high temperatures. In this connection, slag components in pellets of the same particle size distribution were examined after reduction to study whether or not the reducibility at high temperature is largely influenced by the production of molten slag. Since the low melting point slag phase consists of FeO—CaO—$SiO_2$—$Al_2O_3$, it was assumed that the production of the low melting point slag would decrease and the reducibility at high temperatures would be improved all the more upon lessening the content of $CaO+SiO_2+Al_2O_3$. The influence of the gangue contents was studied with regard to the respective particle sizes as it was presumed that the fine/medium and coarse ore particles would have different influences as in the case of basicity.

Firstly, after adjusting basicity by addition of a suitable amount of CaO, 70 wt % of fine/medium ore particles smaller than 0.1 mm (with the compositions of Table 2) were mixed with 30 wt % of coarse ore particles between 0.1 mm and 1.0 mm to produce pellets of the compositions shown in Table 4, followed by measurement of the gangue contents ($CaO+SiO_2+Al_2O_3$) in the fine/medium ore particles in relation with the reducibility at high temperatures according to the following procedures. The respective pellets were heated to 900° C. in a gaseous atmosphere of $CO/CO_2=60/40$ to prepare samples which were preliminarily reduced to the stage of wustite (FeO), and then subjected to reduction test using a reducing gas of $CO/N_2=30/70$ at 1250° C. and for 2 hours.

Figure 2:
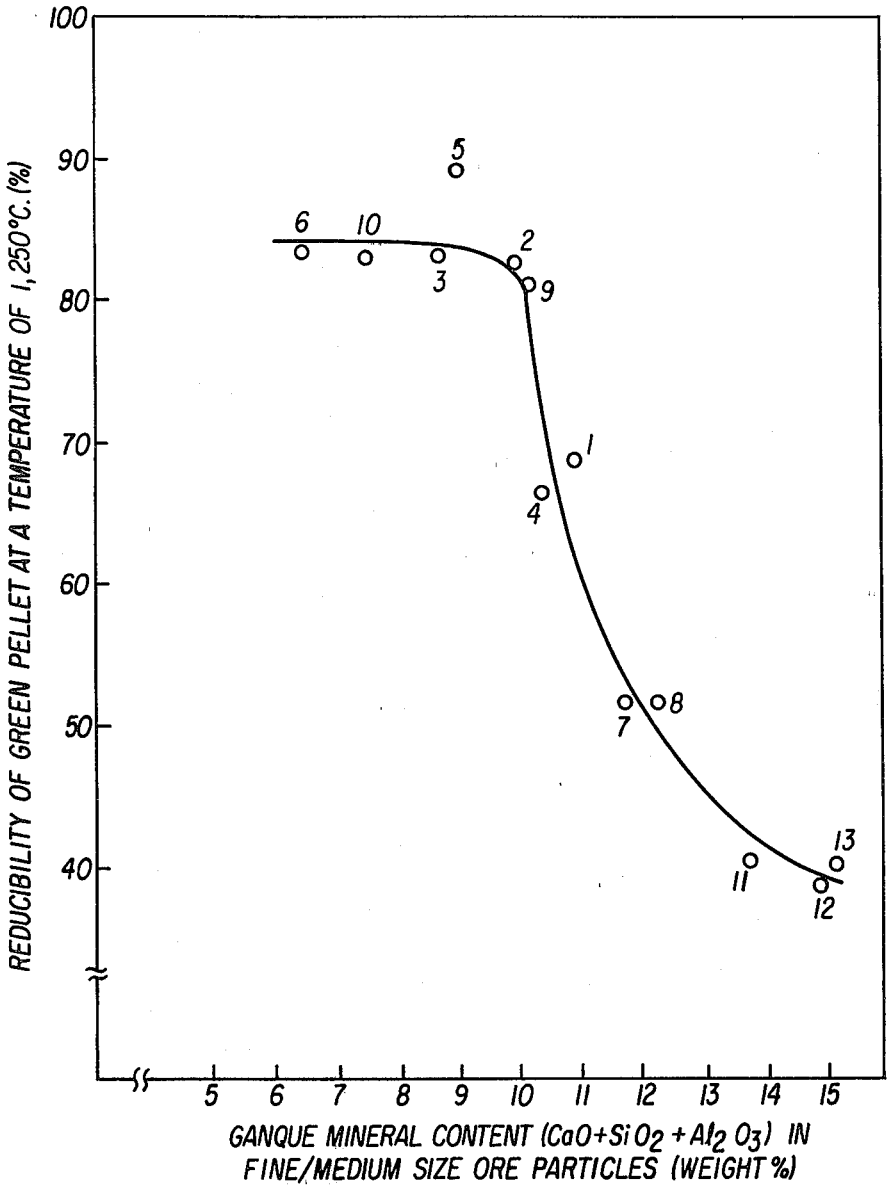
FIG. 2 is a graph showing the relation between the gangue mineral content ($CaO+SiO_2+Al_2O_3$) in fine/-medium ore particles in green pellets and the reducibility.

The results are shown in FIG. 2, in which the numerals indicate the sample numbers.

TABLE 2

| Sample No. | Total Fe | FeO | $SiO_2$ | CaO | $Al_2O_3$ | MgO | CaOl $SiO_2$ | CaO + $SiO_2$ + $Al_2O_3$ |
|---|---|---|---|---|---|---|---|---|
| | Compositions of fine/medium ore | | | | | | | |
| 1 | 61.41 | 2.84 | 4.00 | 4.96 | 1.77 | 1.90 | 1.24 | 10.73 |
| 2 | 61.96 | 2.14 | 3.72 | 4.40 | 1.74 | 1.71 | 1.18 | 9.86 |
| 3 | 63.79 | 1.29 | 3.24 | 3.66 | 1.47 | 1.46 | 1.13 | 8.37 |
| 4 | 60.76 | 1.61 | 3.66 | 4.81 | 1.79 | 2.36 | 1.32 | 10.26 |
| 5 | 57.43 | 1.04 | 3.03 | 4.33 | 1.54 | 2.07 | 1.43 | 8.90 |
| 6 | 64.01 | 0.61 | 1.86 | 3.13 | 1.29 | 1.57 | 1.68 | 6.28 |
| 7 | 59.43 | 3.23 | 3.83 | 6.39 | 1.79 | 2.44 | 1.67 | 12.01 |
| 8 | 59.79 | 4.06 | 3.67 | 6.14 | 1.87 | 2.37 | 1.67 | 11.68 |
| 9 | 60.94 | 2.29 | 2.99 | 5.49 | 1.59 | 2.10 | 1.84 | 10.07 |
| 10 | 63.40 | 0.79 | 2.06 | 4.04 | 1.31 | 1.61 | 1.97 | 7.41 |
| 11 | 57.16 | 0.17 | 5.89 | 5.89 | 1.87 | 1.81 | 1.00 | 13.65 |
| 12 | 57.47 | 0.29 | 5.47 | 7.90 | 1.56 | 2.44 | 1.44 | 14.93 |
| 13 | 56.50 | 3.67 | 5.50 | 7.14 | 2.40 | 2.71 | 1.30 | 15.04 |

(Unit: wt %)

TABLE 3

| Total Fe | FeO | $SiO_2$ | CaO | $Al_2O_3$ | MgO |
|---|---|---|---|---|---|
| | Composition of coarse ore | | | | |
| 68.5 | 0.06 | 1.25 | 0.07 | 0.58 | 0.03 |

(Unit: wt %)

TABLE 4

| Sample No. | Total Fe | FeO | $SiO_2$ | CaO | $Al_2O_3$ | MgO |
|---|---|---|---|---|---|---|
| | Composition of pellets | | | | | |
| 1 | 63.54 | 2.01 | 3.18 | 3.49 | 1.41 | 1.34 |
| 2 | 63.92 | 1.52 | 2.98 | 3.10 | 1.39 | 1.21 |
| 3 | 65.20 | 0.92 | 2.65 | 2.58 | 1.20 | 1.03 |
| 4 | 63.08 | 1.15 | 2.94 | 3.39 | 1.42 | 1.66 |
| 5 | 63.75 | 0.75 | 2.50 | 3.05 | 1.25 | 1.46 |
| 6 | 65.36 | 0.45 | 1.68 | 2.31 | 1.07 | 1.11 |
| 7 | 62.15 | 2.28 | 3.06 | 4.49 | 1.42 | 1.72 |
| 8 | 62.41 | 2.86 | 2.95 | 4.32 | 1.48 | 1.67 |
| 9 | 63.21 | 1.62 | 2.47 | 3.86 | 1.28 | 1.48 |
| 10 | 64.93 | 0.57 | 1.82 | 2.85 | 1.09 | 1.14 |
| 11 | 61.56 | 0.14 | 4.50 | 4.14 | 1.48 | 1.28 |
| 12 | 60.78 | 0.22 | 4.21 | 5.53 | 1.26 | 1.72 |
| 13 | 60.10 | 2.59 | 4.23 | 5.02 | 1.85 | 1.91 |

(Unit: wt %)

As clear from FIG. 2, the reducibility at high temperatures of the pellets are considerably influenced by the gangue contents ($CaO+SiO_2+Al_2O_3$) in the fine/medium ore particles, and becomes higher with smaller gangue contents. Further, although the reducibility varies abruptly in the gangue content range of 9 to 15%, it is preferred to suppress the gangue content below 10% in order to secure the reducibility over 50% which is a criterion generally accepted as satisfactory reducibility at high temperatures.

Nextly, after adjusting basicity by addition of a suitable amount of CaO, 75 wt % of fine/medium ore particles smaller than 0.1 mm (with the compositions shown in Table 5) was mixed with 25 wt % of coarse ore particles greater than 0.1 mm (with the compositions shown in Table 6) to produce pellets of the blends shown in Table 7. The gangue contents ($CaO+SiO_2+Al_2O_3$) in the coarse ore particles of the respective pellets were measured in relation with the temperature of 40% contraction according to the following procedures. Namely, each sample pellet was placed between upper and lower alumina rods through platinum plates and reduced under heating condition while applying from above a load of 0.5 kg/pellet and measuring the deformation of the pellet with a displacement meter. The temperature was raised at a rate of 10° C./min up to 1000° C. and, after maintaining that temperature for 90 minutes, further raised at a rate of 10° C./min up to 1500° C. A reducing gas of $CO/N_2=30/70$ was fed to the furnace at the rate of 1.0 l/min when the temperature of 400° C. is reached.

The contraction was assessed on the basis of the pellet diameter before the test and of the displacement.

TABLE 5

| Sample No. | Total Fe | FeO | $SiO_2$ | CaO | $Al_2O_3$ | MgO |
|---|---|---|---|---|---|---|
| | Compositions of fine/medium ore | | | | | |
| A | 58.0 | 8.10 | 3.96 | 4.67 | 1.78 | 1.27 |
| B | 60.1 | 2.59 | 4.20 | 4.99 | 1.85 | 1.91 |

TABLE 6

| Sample No. | Total Fe | FeO | $SiO_2$ | CaO | $Al_2O_3$ | MgO | CaO + $SiO_2$ + $Al_2O_3$ |
|---|---|---|---|---|---|---|---|
| | Compositions of coarse ore | | | | | | |
| a | 65.2 | 0.03 | 0.94 | 0.05 | 0.65 | 0.06 | 1.64 |
| B | 66.9 | 0.70 | 1.82 | 0.09 | 0.56 | 0.06 | 2.47 |
| c | 60.1 | 0.19 | 3.82 | 0.04 | 2.23 | 0.04 | 6.09 |
| d | 62.7 | 14.90 | 5.61 | 1.03 | 1.07 | 1.58 | 7.71 |
| e | 62.3 | 13.70 | 5.78 | 1.11 | 1.07 | 1.57 | 7.96 |

(Unit: wt %)

TABLE 7

| Pellet No. | Blending Fine/medium ore | Coarse ore |
|---|---|---|
| 1 | A | a |
| 2 | B | b |
| 3 | B | c |
| 4 | B | d |
| 5 | B | e |

Figure 3:
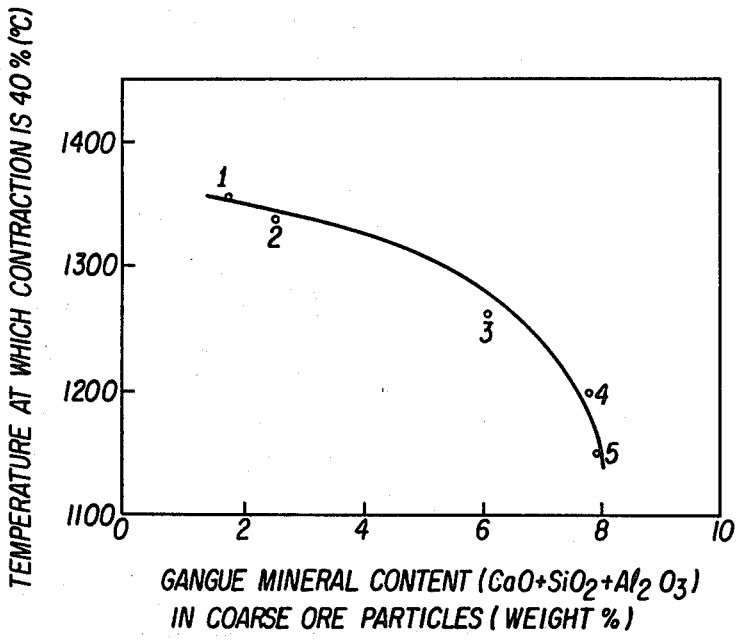
FIG. 3 is a graph showing the relation between the gangue mineral content ($CaO+SiO_2+Al_2O_3$) in coarse ore particles in green pellets and the temperature when showing contraction of 40%.

The results of the contraction tests are shown in FIG. 3, in which the reference numerals indicate the pellet numbers.

As clear therefrom, the temperature of 40% reduction is remarkably influenced by the gangue content ($CaO+SiO_2+Al_2O_3$) in coarse ore particles and becomes higher with a smaller gangue content. In this connection, if the packed layer of pellets shows a contraction greater than 40%, the resistance to air flows in a blast furnace will be increased abruptly to hinder the reducing gas flows. However, if the temperature for 40% contraction is above 1300° C., there occur no such troubles in actual operations. Thus, in order to meet this condition, the gangue mineral content ($CaO+SiO_2+Al_2O_3$) in the coarse ore particles is preferred to be less than 6 wt %.

Thus, the present invention defines the proper particle size distribution of the ore powder for the green pellets, which ensures physical strengths and improved high temperature reducibility, along with the basicity of fine/medium ore particles and the gangue contents in the fine/medium and coarse ore particles which contribute to further improvement of the high temperature reducibility.

What is claimed is:

1. Iron ore pellets containing coarse iron ore particles, said pellets comprising iron ore powder having a particle size distribution consisting of 25–40 wt % of coarse ore particles greater than 0.1 mm in diameter, less than 20 wt % of particles greater than 1 mm in diameter; less than 21 wt % of medium ore particles of 0.1–0.04 mm in diameter; and more than 39 wt % of fine ore particles smaller than 0.04 mm in diameter; wherein the basicity ($CaO/SiO_2$) of the total amount of said fine and medium ore particles is greater than 1.0 and the gangue mineral content ($CaO+SiO_2+Al_2O_3$) in the total amount of said fine and medium ore particles is less than 10 wt %.

2. Iron ore pellets as claimed in claim 1, wherein the gangue mineral content ($CaO+SiO_2+Al_2O_3$) in said coarse ore particles is less than 6 wt %.

3. Iron ore pellets as claimed in claim 1, wherein said powder contains less than 20 wt % of medium ore particles of 0.1–0.04 mm in diameter.

* * * * *

UNITED STATES PATENT AND TRADEMARK OFFICE

CERTIFICATE OF CORRECTION

PATENT NO. : 4,372,779

DATED : February 8, 1983

INVENTOR(S) : TAKESHI SUGIYAMA; SHOJI SHIROUCHI; OSAMU TSUCHIYA; MAMORU ONODA; ATSUKO YAMASHITA; ISAO FUJITA; et al

It is certified that error appears in the above-identified patent and that said Letters Patent is hereby corrected as shown below:

In column 5, line 6, "CaOl" should read --CaO/--;

In column 6, line 23, "B" should read --b--;

Signed and Sealed this

*Nineteenth* Day of *June 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,372,779

DATED : February 8, 1983

INVENTOR(S) : Takeshi Sugiyama et al.

It is certified that error appears in the above-identified patent and that said Letters Patent is hereby corrected as shown below:

| Col. | Line | |
|---|---|---|
| - | - | Figure 2, delete "Green" from vertical axis legend. |
| - | - | Figure 2, substitute "GANGUE" for "GANQUE" in horizontal axis legend. |
| 4 | 55 | After "1.0 mm", insert --(Table 3)--. |
| 6 | 47 | Please change "gas" to --air--. |

Signed and Sealed this

*Nineteenth* Day of *March 1985*

[SEAL]

*Attest:*

DONALD J. QUIGG

*Attesting Officer* *Acting Commissioner of Patents and Trademarks*